US009076372B2

(12) United States Patent
Yang et al.

(10) Patent No.: US 9,076,372 B2
(45) Date of Patent: Jul. 7, 2015

(54) DISPLAY DEVICE AND LIGHT ADJUSTING METHOD THEREOF

(71) Applicant: INNOLUX CORPORATION, Miao-Li County (TW)

(72) Inventors: Cheng-Chung Yang, Miao-Li County (TW); Liang-Lu Chen, Miao-Li County (TW); Chun Yu Chen, Miao-Li County (TW); Hong-Ru Guo, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 18 days.

(21) Appl. No.: 14/013,997

(22) Filed: Aug. 29, 2013

(65) Prior Publication Data

US 2014/0078191 A1 Mar. 20, 2014

(30) Foreign Application Priority Data

Sep. 17, 2012 (TW) ..... 101133965 A

(51) Int. Cl.
*G09G 5/10* (2006.01)
*G09G 3/32* (2006.01)

(52) U.S. Cl.
CPC ..... *G09G 5/10* (2013.01); *G09G 3/3291* (2013.01); *G09G 3/3283* (2013.01); *G09G 2320/0233* (2013.01); *G09G 2320/0626* (2013.01); *G09G 3/32* (2013.01)

(58) Field of Classification Search
CPC ..... G09G 3/3233; G09G 3/32; G09G 3/3225; G09G 3/3283; G09G 2320/0233; G09G 2320/0626; G09G 2320/0646; G09G 5/10; G09G 3/3291
USPC ..... 345/76–83, 214–215, 212, 690–697
See application file for complete search history.

(56) References Cited

U.S. PATENT DOCUMENTS

2010/0141645 A1* 6/2010 Choi et al. ..... 345/214
2010/0245402 A1* 9/2010 Choi et al. ..... 345/690

(Continued)

FOREIGN PATENT DOCUMENTS

KR 100452114 B1 9/2004
TW 201137823 A1 11/2011

OTHER PUBLICATIONS

Taiwan Patent Office, Office action issued on May 27, 2014.
China Patent Office, Office action issued on Apr. 3, 2015.

*Primary Examiner* — Dmitriy Bolotin
(74) *Attorney, Agent, or Firm* — Li & Cai Intellectual Property (USA) Office

(57) ABSTRACT

The present disclosure provides a display device including a light emitting diode and a driving module. The driving module drives the light emitting diode. The driving module includes a first switch circuit, a second switch circuit, and a driver transistor. The first switch circuit selectively writes a gray scale voltage in a first capacitor. The second switch circuit selectively writes an offset voltage in a second capacitor. The driver transistor is coupled to the light emitting diode, the first capacitor, and the second capacitor. The driver transistor adjusts a driving current being outputted to the light emitting diode according to the gray scale voltage and the offset voltage. The gray scale voltage adjusts the voltage difference between the gate and the source of the driver transistor, while the offset voltage adjusts a threshold voltage of the driver transistor.

8 Claims, 5 Drawing Sheets

(56) References Cited

U.S. PATENT DOCUMENTS

2011/0254883 A1 10/2011 Tsai et al.
2012/0007848 A1* 1/2012 Han et al. ..... 345/212
2012/0147070 A1* 6/2012 Segawa et al. ..... 345/694
2012/0154460 A1* 6/2012 Segawa et al. ..... 345/690
2013/0241966 A1* 9/2013 Tsuge ..... 345/690

* cited by examiner

DISPLAY DEVICE AND LIGHT ADJUSTING METHOD THEREOF

BACKGROUND

1. Technical Field

The present disclosure relates to a display device and a light adjusting method thereof, in particular, to a display device and a light adjusting method thereof for adjusting the threshold voltage of the driver transistor.

2. Description of Related Art

Display device for displaying images has been widely used in manufacturing and daily life along with widespread of the multimedia apparatus such as computer, cell phone and television. In a typical Organic Light Emitting Diode (OLED) display device, multiple transistors are utilized to control and drive light emitting diode to have each associated light emitting diode generating proper brightness.

For instance, FIG. 1 shows a schematic diagram illustrating a conventional OLED display device. As shown in FIG. 1, the display device 9 has a switching transistor 90, a capacitor 92, a driver transistor 94, and a light emitting diode 96. The switching transistor 90 being controlled by a scan line SCAN selectively stores the gray scale voltage transmitted by a data line DATA into the capacitor 92 to adjust the driving current outputted by the driver transistor. However, different semiconductors manufactured by same factory may contain discrepancies in the characteristics (e.g., the threshold voltage) thereof. In other words, for same gray scale voltage applied to the driver transistors 94, the driving current outputted may vary.

In view of displayed image, the discrepancies in the driving current may cause mura in brightness of the image thereby affecting user's viewing quality. In order to overcome issue of mura, an addition circuitry is added to each pixel to compensate the difference in the driving current. However, it is known that extra circuitry structure may reduce the opening ratio of pixels. Hence, a new display device is required by the industry with the new display device being capable of adjusting the brightness uniformity of the display imaged without adding new circuit structure in each pixel.

SUMMARY

Accordingly, an exemplary embodiment of the present disclosure provides a display device. The driver transistor of the display device is modified to be a four-terminal element to have the driver transistor adjusting the value of the threshold voltage according to the value of the offset voltage so as to configure the brightness of a light emitting diode through adjusting the driving current.

An exemplary embodiment of the present disclosure provides a display device, and the display device includes a light emitting diode and a driving module. The driving module is used for driving the light emitting diode. The driving module includes a first switch circuit, a second switch circuit, and a driver transistor. The first switch circuit selectively writes a gray scale voltage into a first capacitor. The second switch circuit selectively writes an offset voltage into a second capacitor. The driver transistor is respectively coupled to the light emitting diode, the first capacitor, and the second capacitor. The driver transistor is used for adjusting a driving current outputted to the light emitting diode according to the gray scale voltage and the offset voltage. The gray scale voltage adjusts the voltage difference between the gate and the source of the driver transistor, while the offset voltage adjusts a threshold voltage of the driver transistor.

According to one exemplary embodiment of the present disclosure, when the brightness of the light emitting diode is lower than a first threshold value, the offset voltage decreases the threshold voltage to increase the driving current; when the brightness of the light emitting diode is higher than a second threshold value, the offset voltage increases the threshold voltage to decrease the driving current. The images of the pixels are captured by an image capturing device and a processing device is configured to determine whether the brightness of the light emitting diode of each pixel group in the images captured is lower than the first threshold value or higher than the second threshold value. The first switch circuit and the second switch circuit are switching transistors. The second switch circuit is coupled to an offset data line, and the offset data line is configured for transmitting the offset voltage being outputted by an offset control module. The offset control module adjusts the offset voltage according to the determination result of the processing device. The first switching circuit is coupled to a gray scale data line. The gray level data line transmits the gray scale voltage being outputted by a gray scale control module. The operations of the first switch circuit and the second switch circuit being simultaneously controlled by a scan line.

According to one exemplary embodiment of the present disclosure, the first switch circuit and the second switch circuit are switching transistors. The first switch circuit and the second switch circuit are coupled to a data line, respectively. The data line is respectively coupled to a gray scale control module and an offset control module. The data line is time-multiplexed to transmit the gray scale voltage and the offset voltage. The first switch circuit and the second switch circuit are controlled by a first scan line and a second scan line, respectively. When the first scan line conducts the first switch circuit, the data line transmits the gray scale voltage being outputted by the gray scale control module. When the second scan line conducts the second switch circuit, the data line transmits the offset voltage being outputted by the offset control module.

The present disclosure provides a light adjusting method for a display device, which can adaptably adjust the threshold voltage of a driver transistor to configure the driving current outputted by the driver transistor so as to modify the brightness of the light emitting diode.

An exemplary embodiment of the present disclosure provides a light adjusting method for a display device. The display device has a plurality of pixels. At least one of the pixels has a light emitting diode and a driving module. The driving module has a first switch circuit, a second switch circuit, and a driver transistor. The driver transistor adjusts the driving current according to a gray scale voltage and an offset voltage. The method comprising determining whether the brightness of the light emitting diode is lower than a first threshold value or higher than a second threshold value; adjusting the offset voltage to decrease a threshold voltage of the driver transistor so as to increase the driving current when the brightness of the light emitting diode being lower than the first threshold value; adjusting the offset voltage to increase the threshold voltage of the driver transistor so as to decrease the driving current when the brightness of the light emitting diode is higher than the second threshold value.

To sum up, an exemplary embodiment of the present disclosure provides a display device and the light adjusting method thereof which can adjust the offset voltage outputted to the driver transistor according to the brightness of the display to have the driver transistor adjusting the threshold voltage thereof based on the offset voltage. Accordingly, the driving current outputted by the driver transistor can be configured to adjust the brightness of the light emitting diode. The display device may thus reduce or avoid the occurrence of mura effect thereby improve the viewing quality of the user.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
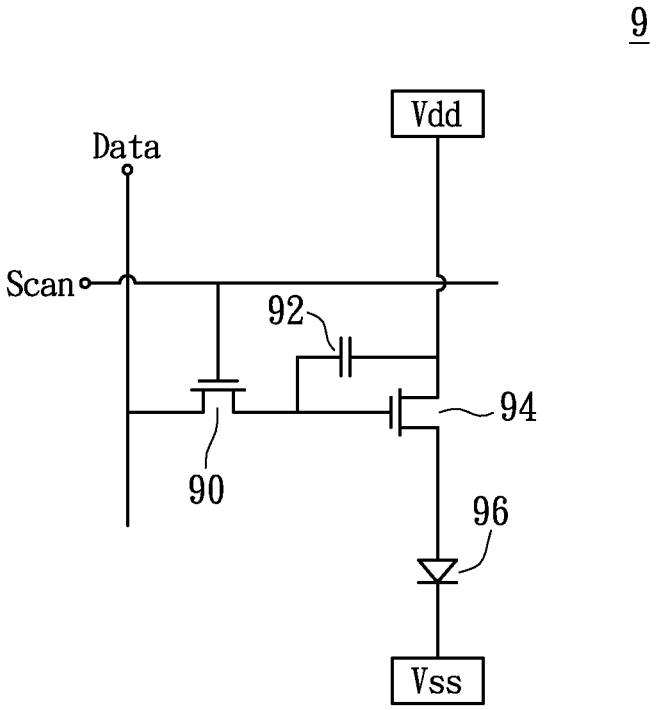
FIG. 1 PRIOR ART
FIG. 1 is a schematic diagram illustrating a conventional OLED display device.

Reference will now be made in detail to the exemplary embodiments of the present disclosure, examples of which are illustrated in the accompanying drawings. Wherever possible, the same reference numbers are used in the drawings and the description to refer to the same or like parts.

Figure 2A:
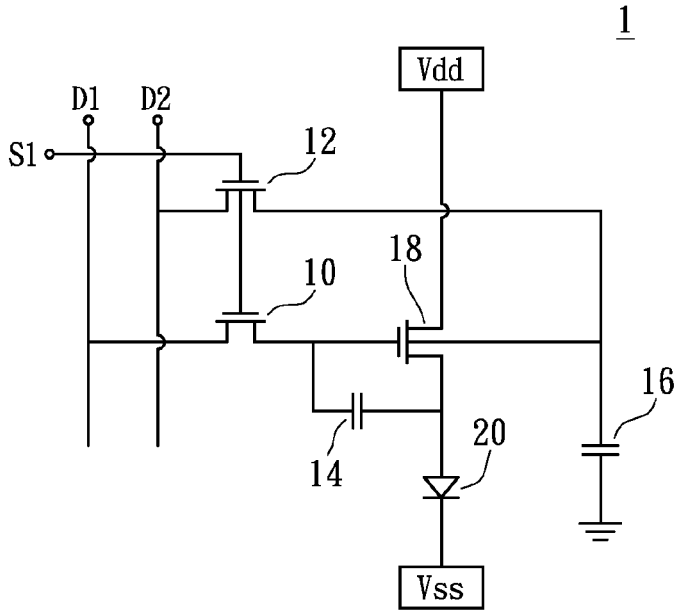
FIG. 2A is a partial schematic diagram illustrating a display device provided in accordance to a first exemplary embodiment of the present disclosure.
Figure 2B:
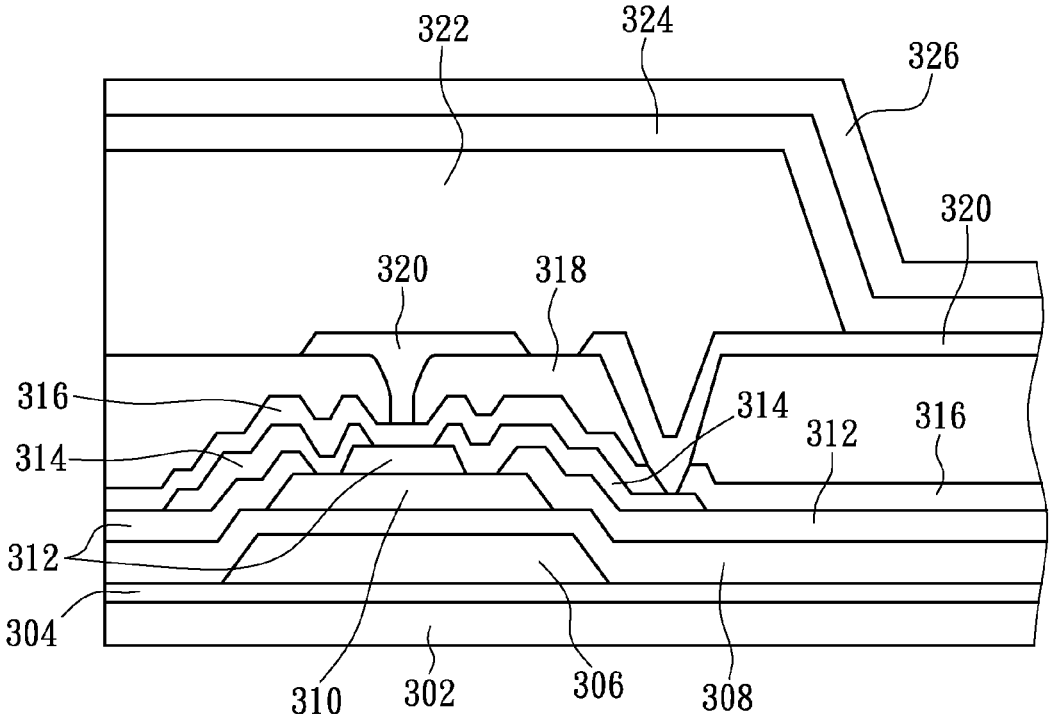
FIG. 2B is a cross sectional diagram illustrating the display device provided in accordance to a first exemplary embodiment of the present disclosure.

Please refer to FIG. 2A and FIG. 2B at same time. FIG. 2A shows a partial schematic diagram illustrating a display device provided in accordance to a first exemplary embodiment of the present disclosure. FIG. 2B shows a cross sectional diagram illustrating the display device provided in accordance to the first exemplary embodiment of the present disclosure. The display device 1 has a plurality of pixels, and at least one of the pixels has a light emitting diode 20 and a driving module (including components 10, 12, 14, 16, and 18) for driving the light emitting diode 20. Specifically, the first switch circuit 10 is coupled to a gray scale data line D1, a first capacitor 14, and a driver transistor 18, respectively. The second switch circuit 12 is coupled to the offset data line D2, a second capacitor 16, and the driver transistor 18, respectively. The driver transistor 18 is a four terminal electrical component. A first gate terminal of the driver transistor 18 is coupled to the first switch circuit 10 and the first capacitor 14, respectively. A second gate terminal of the driver transistor 18 is coupled to the second switch circuit 12 and the second capacitor 16, respectively. A drain terminal of the driver transistor 18 is coupled to a high voltage terminal Vdd while the source terminal of the driver transistor 18 is coupled to the low voltage terminal through the light emitting diode 20. The following paragraphs provide further explanation for each component in the display device 1.

The scan line S1 drives the first switch circuit 10 to selectively conduct or cut-off. When the first switch circuit 10 has been conducted, the gray scale voltage carried by the gray scale data line D1 can be successfully written into the first capacitor 14. In practice, the scan line S1 may be connected to the gate driver (not shown) of the display device 1 and the gate driver can determine the operation of the first switch circuit 10. Although FIG. 2A provided herein uses a transistor to describe one embodiment for the first switch circuit 10, however the present disclosure is not limited thereto. For instance, the first switch circuit 10 may be implemented by multiple transistors or other type of switching component. Alternatively, those skilled in the art shall be able design and implemented the first switch circuit according to the actual needs.

Please continue referring to FIG. 2A, the second switch circuit 12 is also controlled by the scan line S1 to selectively conduct or cut-off. When the second switch circuit 12 has been conducted, the offset voltage carried by the offset data line D2 may successfully be written into the second capacitor 12. In the instant embodiment, the control signal sent on the scan line S1 simultaneously control the operations of the first switch circuit 10 and the switch circuit 12. That is, the gate driver (not shown) simultaneously control the operation of whether to write in the gray scale voltage and the offset voltage, however the present disclosure is not limited thereto. Please note that the instant embodiment only illustrates embodiment of a possible circuitry connections. In other words, so long as the driver transistor 18 can configure the driving current by the gray scale voltage and the offset voltage, those skilled in the art can modify or adjust the circuitry connections to other equivalent circuit connection wherever necessary.

Please refer to the cross sectional diagram of the driver transistor 18 in FIG. 2B for further explanation on the component characteristics and the physical structure thereof. The substrate 302 may be a glass or plastic material and the substrate 302 has an adhesive layer 304 disposed thereon for placing other functional layers. A gate layer 306 of the driver transistor 18 is disposed on the adhesive layer 304. An isolation layer 308 is further disposed on top of the gate layer 306 and the adhesive layer. A channel layer 310 is disposed on the isolation layer 308. A portion of the isolation layer 308 and the channel layer 310 further have an etch stop layer 312 disposed thereon for preventing the structure below the etch stop layer from being damaged during the etching process. The gate layer 306 may comprise of a single or multiple layers of copper, aluminum, molybdenum, titanium, and alloy thereof. The adhesive layer 304, the isolation layer 308, and the etch stop layer 312 may comprise of a single layer or multiple layers of a silicon oxide (SiOx) or silicon nitride (SiNx).

The electrode layer 314 is disposed on the etch stop layer 312 and is in contact with a portion of the channel layer 310. In practice, the left side of the electrode layer 314 being in contact with the channel layer 310 as shown in FIG. 2B may be viewed as the drain of the driver transistor 18 of FIG. 2A, i.e., the left side of the electrode layer 314 is electrically connected to the high voltage terminal Vdd. Additionally, the right side of the electrode layer 314 being in contact with the channel layer 310 as shown in FIG. 2B may be viewed as the source of the driver transistor 18 of FIG. 2A. In order to smooth the post-processes, after disposing a protection layer 316 on the electrode layer 314, a flat layer 318 is further disposed to form a flatter surface. The electrode layer 314 may comprise of a single layer or a multiple layers of copper, aluminum, molybdenum, titanium, and alloy thereof. The material for the flat layer 318 may comprise of organic resin.

In general, the light emitting diode 20 of FIG. 2A is the area formed by the stack of the right side of the electrode layer 320, the light emitting diode 324, and the electrode layer 326 of FIG. 2B (i.e., a light emitting region on the circuit board). An isolation layer 322 is disposed on the left side of the electrode layer 320, i.e., a non-light emitting region on the circuit board. The light emitting diode described herein may comprise of an organic light emitting material. The electrode layers 320 and 326 represent an anode and a cathode thereof, respectively. Alternatively, the light emitting diode 20 may in practice be an organic light emitting diode (OLED). The electrode layer 320 and 326 may comprise of ITO or other appropriate material. The isolation layer 322 may comprise of an organic resin.

Please note that the right side of the electrode layer 320 as illustrated in FIG. 2B is the electrode layer 314 in contact with the right side of the channel layer 310 while the left side of the electrode layer 320 is placed above the channel layer 310. It can be known from the semiconductor operating principle, when the left side of the electrode layer 320 is provided with positive voltage, the electrons easily gathered forming a current path. Accordingly, the threshold voltage of the driver transistor 18 reduces while the driving current outputted increases. Conversely, when the left side of the electrode layer 320 is provided with negative voltage, the electrons are less motivated to form a current path. Accordingly, the threshold voltage of the driver transistor 18 increases while the driving current outputted decreases.

Hence, the structure design of the driver transistor 18 provided in the instant embodiment, the driving current outputted thereof can be adjusted through configuring the threshold of the driver transistor 18 with the offset voltage stored in the second capacitor 16 thereby eliminate the need to increase the number of transistor in each pixel of the display device 1.

The present disclosure further provides another embodiment for illustrating other possible equivalent circuitry connection. Please refer to FIG. 3, which shows a schematic diagram illustrating a partial circuitry of a display device provided in accordance with another embodiment of the present disclosure. Similarly, the display device 4 has a plurality of pixels, and at least one of the pixels has a light emitting diode 50 and a driving module (including components 40, 42, 44, 46, and 48) for driving the light emitting diode 50. The circuit connection and circuit operations of the capacitor 44, 46, driver transistor 48, and the light emitting diode 50 are similar to the previous embodiment, thus further descriptions are hereby omitted. However differ from the previous embodiment, the first switch circuit 40 and the second switch circuit 42 are connected to the same data line D3 and are respectively controlled by different scan lines S2, S3.

Specifically, the data line D3 may time-multiplex to transmit the gray scale voltage and the offset voltage. In particular, the transmitting time for the gray scale voltage or offset voltage correspond to the time that scan lines S2 and S3 control the conduction operations of the first and the second switch circuits. For instance, the scan line S2 drives the first switch circuit 40 to selectively conduct or cut-off. When the first switch circuit 40 has been conducted, the data line d3 transmit the gray scale voltage for the gray scale voltage to be successfully written into the capacitor 44. On the other hand, after the gray scale voltage has been written into the capacitor 44 and the second switch circuit 42 has been conducted, the data line D3 may turn and transmit the offset voltage to have the offset voltage successfully written into the capacitor 46. Those skilled in the art can configure the sequence and the transmission durations of the gray scale voltage and the offset voltage according to the operational needs, hence the instant embodiment is not limited thereof.

Figure 3:
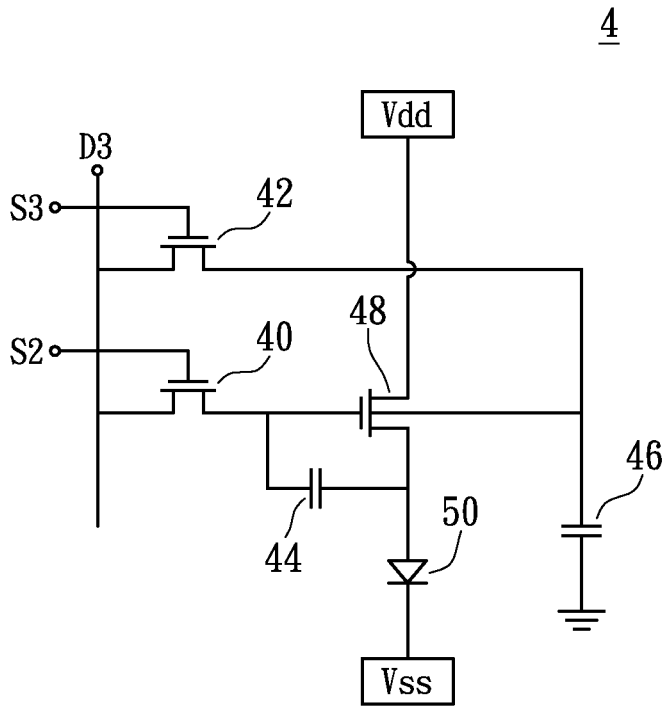
FIG. 3 is a schematic diagram illustrating a partial circuitry of a display device provided in accordance with another embodiment of the present disclosure.

Similarly, FIG. 3 provided herein merely uses transistor to describe one possible embodiment for the first switch circuit 40 and the second switch circuit 42, however the present disclosure is not limited thereto.

Using the embodiment described in FIG. 3 as an example, in order to determine whether the display device 4 has issue of mura effect, a image capture device (not shown) can be employed to capture an image when the display device 4 emits light during the quality control or inspection process. The image capture device may for example be a CCD camera or other appropriate image capturing equipment. A processing device can further analyze or determine whether the brightness of the light emitting diode 50 of each pixel in the image captured by the image capture device qualifies the standard i.e., whether the brightness being lower than the first threshold value (i.e., too dark) or higher than the second threshold value (i.e., too bright). The first threshold value and the second threshold value may be predetermined by the user. The first threshold value and the second threshold value may be equal or defined as a maximum and minimum of a specific range, however the instant embodiment is not limited thereto.

The first threshold value and the second threshold value may be in practice predefined in a lookup table. The lookup table may record the relation between the brightness and the offset voltage. For instance, when the processing device determines that the light emitting diode 50 of a certain pixel is too dark or too bright, the processing device may look for the offset voltage to compensate the driver transistor 48 and store the offset voltage in the capacitor 46 via the second switch circuit 42. Such that the threshold voltage can be dynamically adjusted while the brightness of the pixels falls in an acceptable range.

Figure 4A:
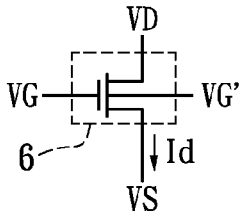
FIG. 4A is a schematic diagram illustrating the driver transistor provided in accordance to an embodiment of the present disclosure.
Figure 4B:
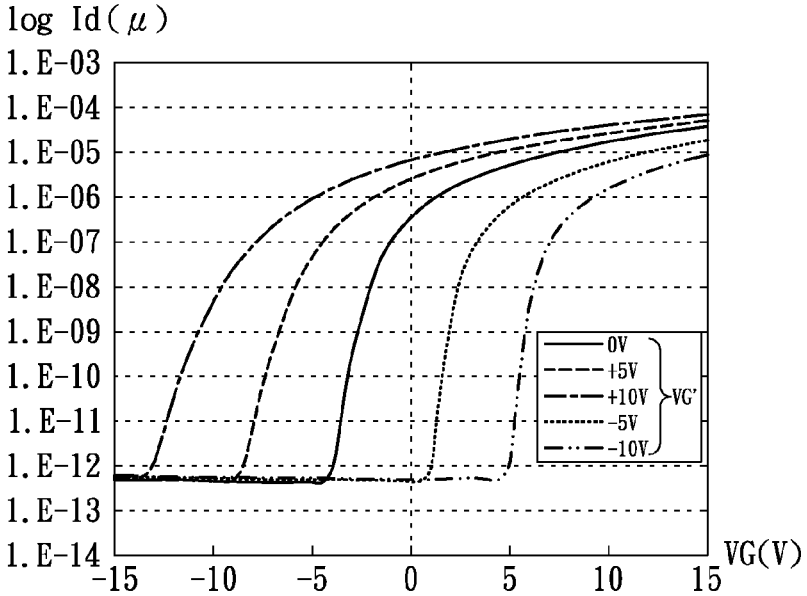
FIG. 4B is a diagram illustrating the relationship among the driving current, gray scale voltage, and offset voltage provided in accordance to an embodiment of the present disclosure.
Figure 4C:
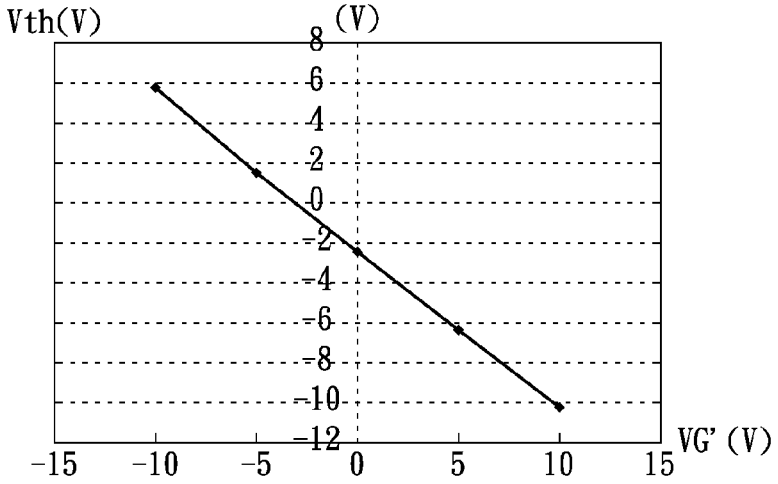
FIG. 4C is a diagram illustrating the relationship between the threshold voltage of the driver transistor and the offset voltage provided in accordance to an embodiment of present disclosure.

In view of actual measuring data in conjunction with FIG. 4A, FIG. 4B, and FIG. 4C in conjunction with actual measuring data. FIG. 4A shows a schematic diagram illustrating the driver transistor provided in accordance to an embodiment of the present disclosure. FIG. 4B shows a diagram illustrating the relationship among the driving current, the gray scale voltage, and the offset voltage provided in accordance to the embodiment of the present disclosure. FIG. 4C shows a diagram illustrating the relationship between the threshold voltage of the driver transistor and the offset voltage provided in accordance to the embodiment of present disclosure. The driver transistor 6 has a first gate terminal VG, a second gate terminal VG', source terminal VS, and drain terminal VD. The first gate terminal VG is coupled to the first switch circuit and the capacitor for storing gray scale voltage of aforementioned embodiment. The second gate terminal VG' is coupled to the second switch circuit and the capacitor for storing the offset voltage of the aforementioned embodiment.

It can be noted from the data shown in FIG. 4B that under the condition of a fix gray scale voltage (e.g., VG is 8V), the offset voltage received at the second gate terminal VG' increases and the driving current Id increases, accordingly. Additionally, it can be observed from the data shown in FIG. 4C, when the second gate terminal VG' receives higher offset voltage, the threshold voltage Vth of the driver transistor 6 becomes lower. It can be known from the basic current equation that the driving current is inversely proportional to the threshold voltage Vth i.e., the lower the threshold voltage Vth, the higher the driving current Id; the higher the threshold voltage Vth, the lower the driving current Id. Thus, the driver transistor 6 provided in the instant embodiment may easily adjust the driving current outputted to the light emitting diode by using different offset voltage.

In order for those skilled in the art clearly understand the spirit of the present disclosure, the follow paragraph describes the light adjusting method for the display device in detail.

Figure 5:
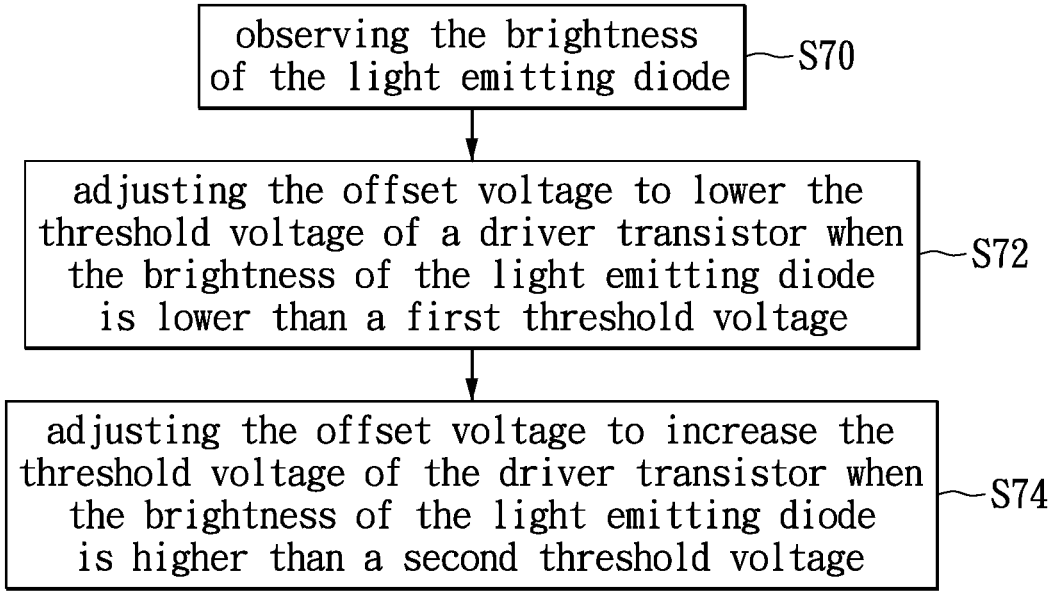
FIG. 5 is a flow chart diagram illustrating a light adjusting method of the display device provided in accordance to an embodiment of the present disclosure.

Please refer to FIG. 5 in conjunction with FIG. 3, wherein FIG. 5 shows a flow chart diagram illustrating a light adjusting method of the display device provided in accordance to an embodiment of the present disclosure. In Step S70, the present disclosure utilize an image capture device (not shown) to capture an image when the display device 4 emits light. The processing device (not shown) is further used to determine whether the brightness of the light emitting diode 50 of each pixel in the image captured by the image capture device is lower than the first threshold value (i.e., too dark) or higher than the second threshold value (i.e., too bright).

In Step S72, when the processing device determines that the light emitting diode 50 of a certain pixel group is too dark, the processing device increases the offset voltage outputted to the capacitor 46 to lower the threshold voltage of the driver transistor 48 so as to increase the driving current flowing through the light emitting diode 50 thereby increase the brightness of the light emitting diode 50. In Step S74, when the processing device determines that the light emitting diode 50 of a certain pixel is too bright, the processing device decreases the offset voltage outputted to the capacitor 46 to increases the threshold voltage of the driver transistor 48 so as to decrease the driving current flowing through the light emitting diode 50 thereby reduce the brightness of the light emitting diode 50.

In summary, an exemplary embodiment of the present disclosure provides a display device and the light adjusting method thereof which can adjust the offset voltage outputted to the driver transistor according to the brightness of the display to have the driver transistor adjust the threshold voltage thereof based on the offset voltage. Accordingly, the driving current outputted by the driver transistor can be configured to adjust the brightness of the light emitting diode. The display device may thus reduce or avoid the occurrence of mura effect thereby improve the viewing quality of the user.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A display device with a plurality of pixels, at least one of the pixels comprising:

a light emitting diode; and a driving module, used for driving the light emitting diode, and the driving module comprising:

a first switch circuit, selectively writing a gray scale voltage into a first capacitor;

a second switch circuit, selectively writing an offset voltage into a second capacitor; and a driver transistor, respectively coupled to the light emitting diode, the first capacitor, and the second capacitor, adjusting a driving current outputted to the light emitting diode according to the gray scale voltage and the offset voltage;

wherein, the gray scale voltage adjusts the voltage difference between a gate and a source of the driver transistor, and the offset voltage adjusts a threshold voltage of the driver transistor;

wherein when the brightness of the light emitting diode is lower than a first threshold value, the offset voltage decreases the threshold voltage to increase the driving current; when the brightness of the light emitting diode is higher than a second threshold value, the offset voltage increases the threshold voltage to decrease the driving current.

2. The display device according to claim 1, wherein images of the pixels are captured by an image capturing device and determines whether the brightness of the light emitting diode of the pixels is lower than the first threshold value or higher than the second threshold value through a processing device.

3. The display device according to claim 2, wherein the first switch circuit and the second switch circuit are switching transistors, the second switch circuit being coupled to an offset data line, the offset data line being configured for transmitting the offset voltage being outputted by an offset control module, and the offset control module adjusting the offset voltage according to the determination result of the processing device.

4. The display device according to claim 3, wherein the first switching circuit is coupled to a gray scale data line and the gray level data line transmits the gray scale voltage being outputted by a gray scale control module, the operations of the first switch circuit and the second switch circuit being simultaneously controlled by a scan line.

5. The display device according to claim 2, wherein the first switch circuit and the second switch circuit are switching transistors, the first switch circuit and the second switch circuit being coupled to a data line, respectively, with the data line being respectively coupled to a gray scale control module and an offset control module, and the data line time-multiplexed to transmit the gray scale voltage and the offset voltage.

6. The display device according to claim 5, wherein the first switch circuit and the second switch circuit are controlled by a first scan line and a second scan line, respectively; when the first scan line conducts the first switch circuit, the data line transmits the gray scale voltage being outputted by the gray scale control module; when the second scan line conducts the second switch circuit, the data line transmits the offset voltage being outputted by the offset control module.

7. A light adjusting method for a display device with a plurality of pixels, at least one of the pixels comprising a light emitting diode and a driving module, the driving module having a first switch circuit, a second switch circuit, and a driver transistor, the driver transistor adjusting the driving current according to a gray scale voltage and an offset voltage, the method comprising:

determining whether the brightness of the light emitting diode is lower than a first threshold value or higher than a second threshold value;

adjusting the offset voltage to decrease a threshold voltage of the driver transistor so as to increase the driving current when the brightness of the light emitting diode is lower than the first threshold value; and adjusting the offset voltage to increase the threshold voltage of the driver transistor so as to decrease the driving current when the brightness of the light emitting diode is higher than the second threshold value.

8. The light adjusting method according to claim 7, wherein the step of determining whether the brightness of the light emitting diode is lower than the first threshold value or higher than the second threshold value further comprises:

capturing an image containing the pixels; and determining whether the brightness of the light emitting diode of the pixels is lower than the first threshold value or higher than the second threshold value.

* * * * *